United States Patent [19]

Irigoyen et al.

[11] Patent Number: 4,876,836

[45] Date of Patent: Oct. 31, 1989

[54] SUPPORT AND ATTACHMENT SYSTEM FOR LONG-SPAN BEAMS

[76] Inventors: Marc E. Irigoyen, 53, cours de l'Intendance, 33000 Bordeaux; Pierre Bourrier, 2, rue de La Planche, 75007 Paris, both of France

[21] Appl. No.: 276,449

[22] PCT Filed: Feb. 22, 1988

[86] PCT No.: PCT/FR88/00096

§ 371 Date: Oct. 24, 1988

§ 102(e) Date: Oct. 24, 1988

[87] PCT Pub. No.: WO88/06214

PCT Pub. Date: Aug. 25, 1988

[30] Foreign Application Priority Data

Feb. 23, 1987 [FR] France ..... 87 02306

[51] Int. Cl.[4] ..... E04B 1/36

[52] U.S. Cl. ..... 52/263; 52/299; 52/721; 248/218.4

[58] Field of Search ..... 52/721, 263, 299, 300; 248/676, 359 E, 218.3, 218.4, 219.1, 219.2, 188.1, 434, 435

[56] References Cited

U.S. PATENT DOCUMENTS

| | | | |
|---|---|---|---|
| 816,158 | 3/1906 | Erickson | 248/434 X |
| 967,471 | 8/1910 | Wanamaker | 248/434 |
| 4,260,293 | 4/1981 | Peterson | 52/263 X |

FOREIGN PATENT DOCUMENTS

| | | | |
|---|---|---|---|
| 516495 | 12/1954 | Belgium . | |
| 64238 | 9/1892 | Fed. Rep. of Germany | 248/218.4 |

*Primary Examiner*—John E. Murtagh

*Attorney, Agent, or Firm*—Browdy and Neimark

[57] ABSTRACT

Improved system ensuring the support and securing of long support beams of wood core plywood or composite materials (1A, 1B . . . ) on metal support posts (2B . . . ), characterized by the fact that each post is provided with at least one scaffolding strut ($3B_1$, $3B_2$ . . . ) articulated at its lower end on a hinge pin ($5_1$, $5_2$ . . . ), integral with the adjoining post, the upper end being provided with a receiving angle ($6_1$, $6_2$ . . . ) which bears a corner piece ($7_1$, $7_2$), integral with the end of a long supporting beam (1A, 1B . . . ) by means of contact pieces ($8_1$, $8_2$ . . . ) fitted to said corner piece; the vertical reaction of the weight of the beam $R_v$ is thereby transferred, by the application of load to the scaffolding $R_p$, to the axis of the integral strut ($3B_1$, $3B_2$), said load creating a horizontal load of longitudinal stress $R_H$ in the adjoining long supporting beam.

19 Claims, 4 Drawing Sheets

FIG. 4
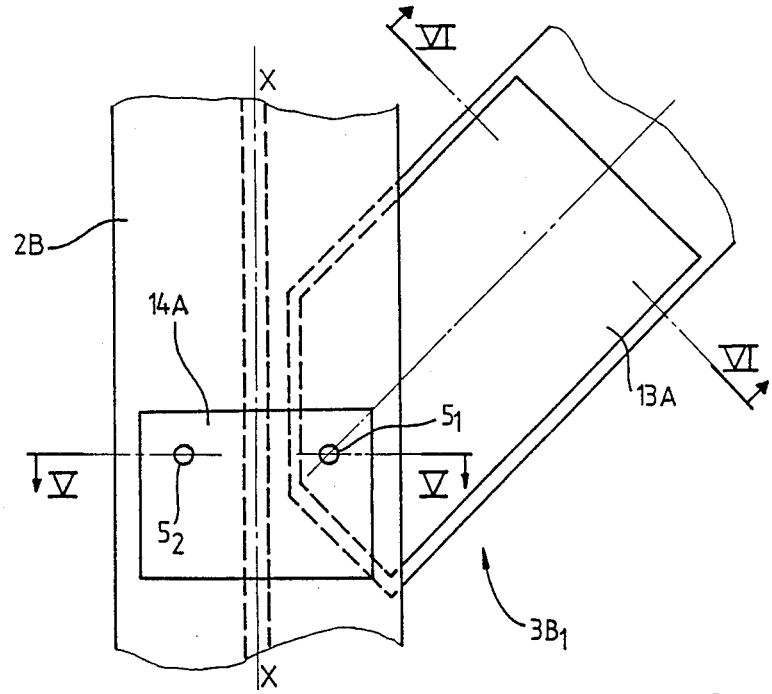
FIG. 5
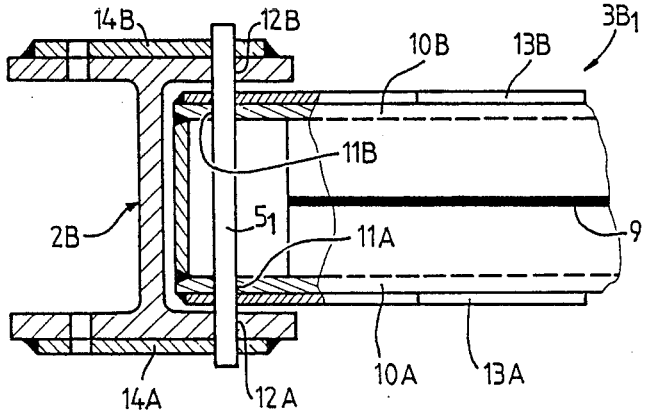
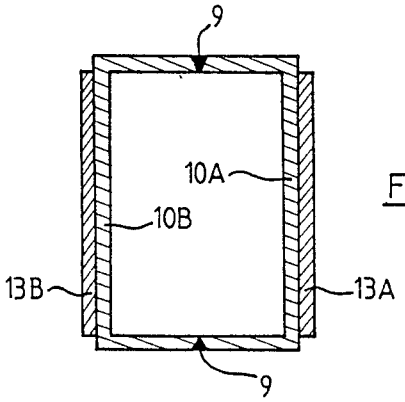
FIG. 6

SUPPORT AND ATTACHMENT SYSTEM FOR LONG-SPAN BEAMS

First of all, it must be borne in mind that in the public works and construction industry the possibility of using long-span beams constitutes an indispensable advantage, in particular in that it enables wide-mesh lattice floors to be constructed.

The present invention is generally concerned with the construction of long spans such as those found in large commercial premises and in industrial buildings, through the combination of, on the one hand, long-span beams, preferably of adhesively bonded laminate material or composite material, to the exclusion of metal materials and concrete, constituting the parallel sides of a lattice with conventional crossmembers and, on the other hand, supporting structural steelwork.

To be more specific, the present invention concerns an improved system for supporting and attaching long-span laminated or composite material beams on and to metal support posts, the system being designed to transfer the vertical reaction force to the weight of the beam into a buttress force in the corresponding post and so to create a horizontal longitudinal stress force in the beam which increases the permissible span for said beam.

The improved system in accordance with the invention is characterized in that each post is provided with at least one buttress leg member articulated at its lower end to an articulation shaft attached to the corresponding post and the upper end of which is provided with a two-wing channel on which bears a corner strengthening member attached to the end of a long-span beam through contact members on said corner strengthening member, whereby the vertical reaction force to the weight of the beam is converted to a buttress force on the axis of the corresponding buttress leg member which produces a horizontal longitudinal compression force in the corresponding long-span beam.

According to other characteristics of the invention:

- each intermediate post along the structure carries two buttress leg members symmetrically disposed and articulated relative to the longitudinal axis of symmetry of the post and each adapted to receive a respective end of a long-span beam, whereby the two buttress forces in the two buttress leg members balance each other;
- each of the two end posts carries a single buttress leg member adapted to receive the end of the end long-span beam of the structure, the second buttress leg member being replaced by a bracing member balancing the buttress force applied to the post by the buttress leg member.

Other characteristics and advantages of the present invention will emerge from the following description of it given by way of preferred example only and with reference to the appended diagrammatic drawings showing one possible embodiment of said invention. In the drawings FIG. 1 is a diagram showing in a particularly simple way the basic principle of the invention;

FIG. 4 is a detail view to a larger scale showing in elevation the device for attachment and pivoting of the base of one of the buttress arm members to an intermediate post like that of FIGS. 2 and 3;

FIG. 5 is a detail view of the attachment and pivoting device from FIG. 4 shown in plan, partially cut away and in horizontal cross-section on the line V—V in said FIG. 4;

FIG. 6 is a view of the buttress arm member proper in transverse cross-section on the line VI—VI in FIG. 4;

Figure 1:
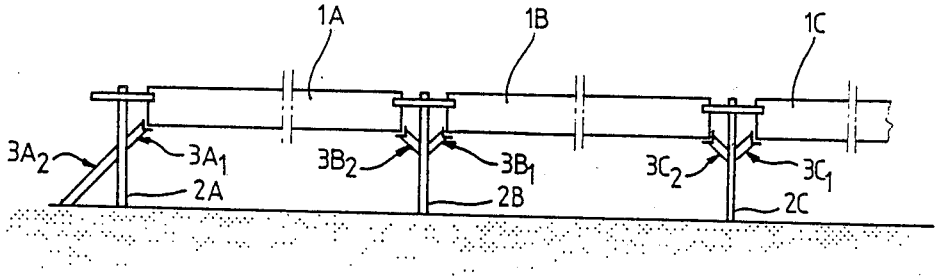

Referring first of all to the diagram in FIG. 1 showing the principle of the invention, it will be remembered that the invention is generally concerned with constructing long span through combining:

- on the one hand, long-span beams such as 1A, 1B, 1C, etc. of adhesive bonded laminate or composite material, to the exclusion of metal materials and concrete, constituting the parallel longitudinal sides of a lattice; and
- on the other hand, supporting structural steelwork consisting of H-section posts such as 2A, 2B, 2C, etc.

As has already been mentioned, the invention is more specifically concerned with the improved system for supporting and attaching the beams 1A, 1B, 1C, etc. on and to the corresponding 2A, 2B, 2C, etc.

As can be seen FIG. 1, each supporting system comprises a double support system, namely $3A_1$, $3A_2$ for post 2A and beam 1A; $3B_1$, $3B_2$ for post 2B and beams 1B and 1A; $3C_1$, $3C_2$ for post 2C and beams 1C and 1B; and so on up the last post of the run (not shown) at the other end the aligned beams.

There will now explained with reference to FIGS. 2 through 9 h each system is adapted to transfer the vertical reaction force to the weight of the beam into a buttressing force on the corresponding post and so to create in said beam a horizontal longitudinal stress which increases the maximum possible span for a beam of this type.

Referring first all and specifically to the double support system $3B_1$, $3B_2$ for the post 2B and the beams 1A and 1B which shown in FIGS. 2 through 8, it is seen that the system is symmetrical relative to the longitudinal axis of symmetry XX of the post, in this instance the post 2B, comprising two identical buttress leg members $4_1$, $4_2$ articulated at their lower end on a shaft $5_1$, $5_2$ pinned to the post 2B, free of any friction or other moment of force, and to be described in more detail later. These buttress leg members are provided at their upper end with supports in the of two-wing channels $6_1$, $6_2$.

Corner strengthening members $7_1$, $7_2$ are attached, adhesively bolted or riveted, for example to the bottom of the corresponding beams 1B, 1A, these corner strengthening members comprising members $8_1$, $8_2$ through which they contact the corresponding two-wing channels $6_1$, $6_2$.

Before proceeding with a more detailed description of the buttress leg members, it can be seen immediately that, for each of these leg members, the vertical reaction force $R_V$ to the weight of the beam 1B or 1A is transferred a buttress force $R_P$ in the corresponding leg me which creates in the beam 1B or 1A a horizontal longitudinal stress force $R_H$ which increases the permissable span for said beam.

It is important that, because of the way in which the support is designed, the forces exerted are obliged to pass through specific points, namely the articulation $5_1$, $5_2$ for the thrust $R_P$ on the buttress leg member $4_1$, $4_2$, the contact members $8_1$ and $8_2$ for vertical reaction force $R_V$ (in practice 30 T for 24 m spans), and the horizontal abutment providing the longitudinal stress $M=R_H.e$ in the beam, where e is the shortest distance between the point through which the horizontal stress $R_H$ passes and the neutral fiber of the beam 1B.

Figure 2:
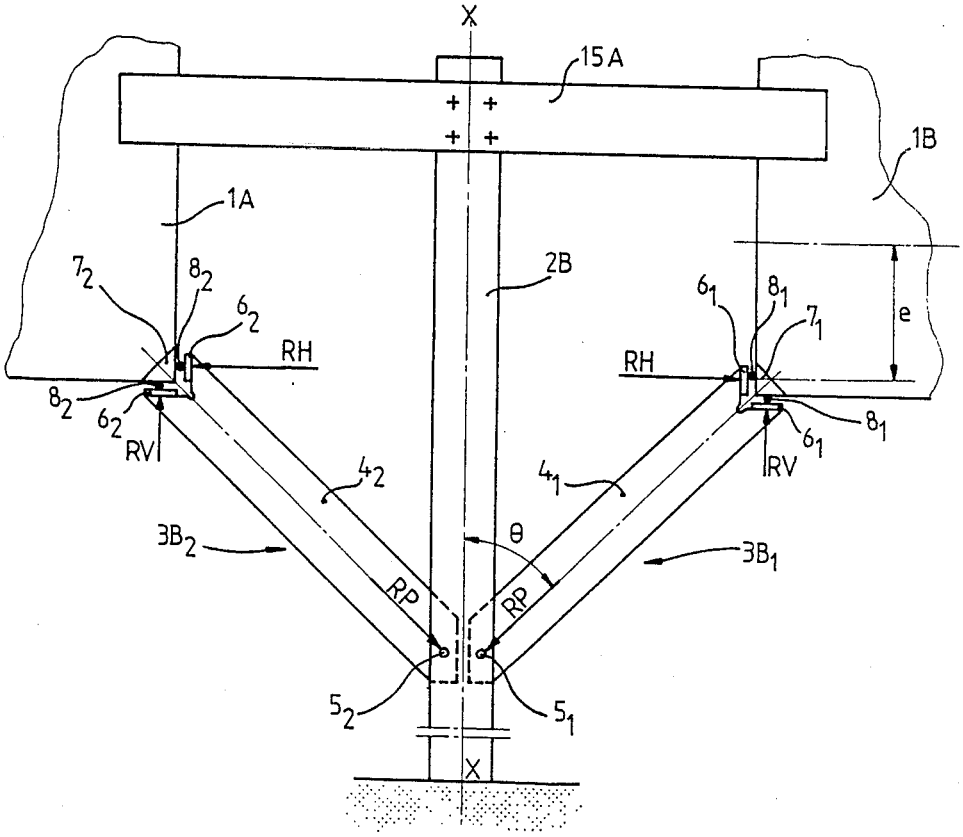
FIG. 2 is a detail view to a much larger scale showing in elevation the upper part of an intermediate post with two buttress leg members receiving the ends of two long-span beams.
Figure 3:
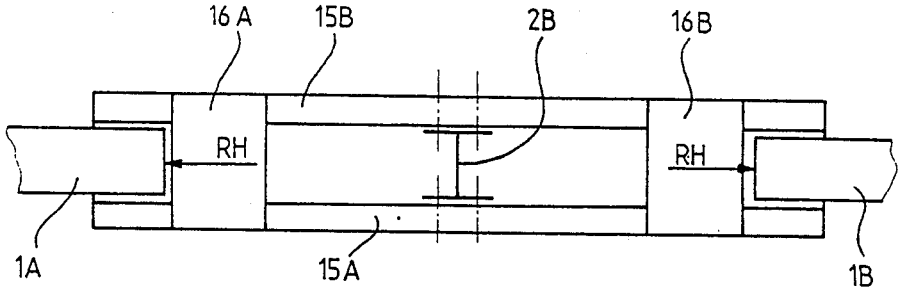
FIG. 3 is a plan view of the aforementioned assembly.

There will now described in detail, with specific reference to FIGS. 4 through 8, how each of the buttress leg members $4_1$, $4_2$ in FIG. 2 can be implemented in an advantageous way.

As these leg have to be designed to resist buckling, each is made (see FIG. 6) by welding longitudinally at 9 two asymmetrical channel members 10A, 10B. These members comprise at their lower end, cut to form an asymmetrical point (see FIG. 4), an orifice 11A, 11B enabling the leg member as a whole to pivot on the support shaft $5_1$ pinned in orifices 12A, 12B formed in the flanges of the H-section post 2B.

To spread local stresses there are fixed to the surfaces of the leg and to the surfaces of the flanges of the post concerned anti-buckling reinforcing plates, for example the lateral plates 13A and 13B on the leg member proper and plates 14A and 14B on the flanges of the post.

It has already been seen, from the description relating to FIG. 2, that beam 1B bears at its end on the upper end of the corresponding leg member $4_1$ and that the supporting system is designed, in accordance with the invention so that the applied forces $R_V$, $R_H$ and $R_P$ are obliged to pass through specific points to make the calculation and control of the forces concerned as easy and accurate as possible.

Figure 7:
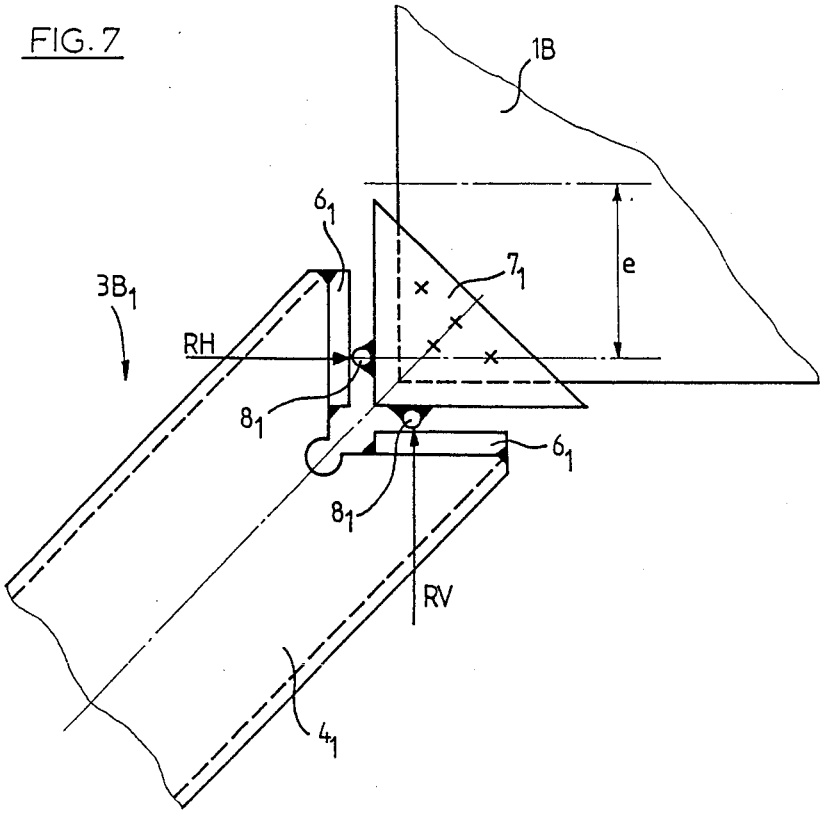
FIG. 7 is a view in elevation of the upper end of the buttress arm member from FIGS. 4, 5 and 6, showing how it is adapted to receive the end of a long-span beam.
Figure 8:
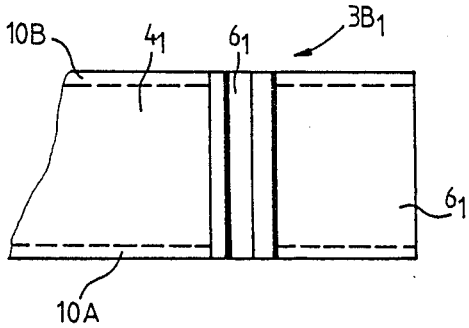
FIG. 8 is a plan view of the end of said arm member as shown in FIG. 7.

FIGS. 7 and 8 show to a larger scale the preferred embodiment of the invention.

In this case, the end of the beam 1B is fitted with a corner strengthening member $7_1$ with two flanges at right angles each fitted with a contact cylinder (or half-cylinder) $8_1$ which on the corresponding member $6_1$ of the two-wing support channel welded to the upper end of the buttress leg member $4_1$. It is seen immediately that in this case the vertical and horizontal forces $R_V$ and $R_H$ and the points at which they are applied are perfectly determined and controllable immediately the beam 1B is placed (see FIG. 1) on the buttress leg members $3B_1$ and $3C_2$ of the posts 2B and 2C.

The horizontal stress generated in the beam 1B in this way increases the maximum possible span for this type of beam, as already mentioned.

It is also seen that there will be automatic compensation of any aging of the material constituting the beam, preferably adhesively bonded laminate or composite materials such as woven polyester, tubes, fibers, etc., to the exclusion of metal and concrete.

It is evident that it would be possible to use a leg member/corner strengthening member articulation whereby the corner strengthening member on which the beam is placed would be articulated to the buttress leg member, but that this solution would have undoubted a priori assembly and use problems.

Moreover, consideration might be given to the corner strengthening member $7_1$ comprising only a single contact cylinder of large radius resting on the two wings of the two-wing channel $6_1$ on the buttress leg member, but here again this solution would involve problems of fixing the single cylinder to the corner strengthening member and controlling the distances to the points of application of the vertical force $R_V$ and horizontal force $R_H$.

There is no doubt that the preferred solution previously described is significantly superior in that the points through which said forces are obliged to pass are perfectly defined by the contact cylinders $8_1$ of the corner strengthening member $7_1$ resting on the two-wing channel $6_1$ of the member $4_1$.

Given that, as has just been seen, the beams 1B and 1A are simply rested through their corner strengthening members $7_1$, $7_2$ on the buttress leg members $4_1$, $4_2$, the post 2B is extended upwardly and provided at the top (see FIGS. 2 and 3) with two anti-toppling beams 15A, 15B which are riveted at their center to the flanges of the H-section post 2B and embrace laterally the ends of the aligned beams 1B and 1A.

Also, the same beams may be linked by plates such as 16A, and serve as supports for equipment such as air conditioning, heating or other equipment.

The angle $\theta$ between the buttress leg member $4_1$ and the vertical axis of symmetry XX of the post 2B is determined according to the characteristics of the component parts of the long-span structure to be built (beams, posts, minimum ceiling height, etc.).

Mathematical theory requires that the center of gravity of the long-span 1B, the geometric center of the corner strengthening member $7_1$ with which said beam is provided and the geometric center of the articulation $5_1$ on the 2B are disposed on the same circular arc.

In practice, the angle $\theta$ must be between 30° and 60° and preferably equal to 45°, as this is much simpler from the practical constructional point of view.

Figure 9:
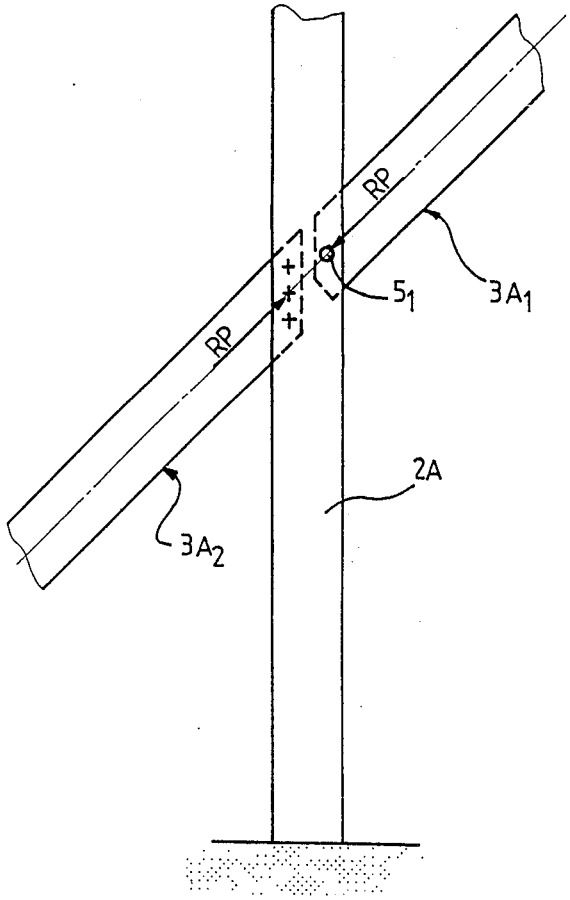
FIG. 9 is a detail view in elevation showing how each of the end posts is adapted to compensate the lateral force exerted by long-span beam on the post in question.

According to another characteristic of the invention, the end posts like the post 2A in FIGS. 1 and 9, where the effect of the horizontal force $R_H$ which is produced in the part 1A and which is transferred into a buttressing force $R_P$ on the post 2A is not balanced by the symmetrically opposed action of another beam, as is the case, for example, with the post 2B, have to be compensated, as here, by a bracing leg member $3A_2$ which is at its upper end to the flanges of the post 2A and is aligned with the buttressing leg member $3A_1$ with its lower end resting on the ground, as clearly seen in FIG. 1. In this way the assembly is perfectly balanced.

Generally speaking, the invention proposes an improved system for supporting and attaching long-span laminate or composite material beams on and to metal supporting posts, comprising on each post at least one buttress leg member articulated at its lower end to said post and by which one end of a long-span beam is supported by the post, contact members on the beam or at the upper end of the buttress leg member, and bearing members at the upper end of the buttress leg member or on the beam on which the contact members bear, the arrangement of the contact members and the bearing members being such that the weight of the beam produces a longitudinal compression force along the axis of the leg member which produces a longitudinal compression force on the beam.

It is to be understood that the present invention is in no way limited to the embodiment described and shown, but to the contrary encompasses any variants thereon within the competence of those skilled in the art.

We claim:

1. Improved system for supporting and attaching long-span laminate or composite material beams (1A, 1B, 1C, etc.) on and to metal supporting posts (2A, 2B, 2C, etc.), characterised in that each post is provided with at least one buttress member ($3A_1$, $3B_1$, $3C_1$, etc.) articulated at its end to an articulation shaft ($5_1$, $5_2$, etc.) a to the corresponding post and the upper end of which is provided with a two-wing channel ($6_1$, $6_2$, etc.) on which bears a corner strengthening member ($7_1$, $7_2$) attached to the end of a long-span beam (1A, 1B, etc.) through the intermediary of contact members ($8_1$, $8_2$, etc.) with which said corner strengthnening member is provided, whereby the vertical reaction force $R_V$ to the weight of the beam is transferred into a buttress force $R_P$ on the axis of the corresponding leg member ($3B_1$, $3B_2$)

which produces a horizontal longitudinal stress force $R_H$ in the corresponding long-span beam.

2. Improved system according to claim 1, characterised in that each intermediate post on the length of the structure (2B, 2C, etc.) comprises two buttress leg members ($4_1$, $4_2$) symmetrically disposed and pivoted relative to the longitudinal axis of symmetry (X—X) of the post and each adapted to receive the end of a long-span beam (1A-1B 1B-1C, etc.), whereby the two buttress forces ($R_P$—$R_P$), in the two leg members ($4_1$, $4_2$) balance each other.

3. Improved system according to claim 1, characterised in that each of the end posts (2A) comprises a single buttress leg member ($3A_1$) adapted to receive the end of the end long-span beam (1A) of the structure, the second buttress leg member being replaced by a bracing leg member ($3A_2$) balancing the buttress force $R_P$ applied to the post by the buttress leg member ($3A_1$).

4. Improved system according to any one of claims 1 to characterised in that the contact members ($8_1$, L $8_2$, etc.) with which the corner strengthening member ($7_1$, $7_2$) of the long-span beam (1A, 1B, etc.) is provided comprise two small-diameter cylindrical members ($8_1$—$8_1$, $8_2$—$8_2$) orthogonal to the beam and adapted to bear on respective wings of the two-wing channel ($6_1$, $6_2$) attached to the upper end of the buttress leg member ($4_1$, $4_2$, etc.), these contacts constituting points through which the forces are obliged to pass.

5. Improved system according to claim 1 characterised in that, in one embodiment, the corner strengthening member ($7_1$, $7_2$) of the beam (1A, 1B) is provided with a single larger diameter contact cylinder ($8_1$ or $8_2$) orthogonal to the beam which bears on both wings of the two-wing channel ($6_1$, $6_2$) attached to the upper end of the buttress leg member ($4_1$, $4_2$, etc.) along two separate generatrices of said cylinder, these contacts constituting points through which the forces are obliged to pass.

6. Improved system according to any one of claims 1 to 5, characterised in that each buttress leg member ($4_1$, $4_2$, etc.) is made by welding longitudinally (9) two asymmetrical U-shaped cross-section members (10A, 10B) and in that, facing the articulations ($5_1$, $5_2$) between leg member and post, anti-buckling reinforcing plates are fixed to the lateral surfaces of the leg member (13A, 13B) and to the lateral surfaces of the flanges of the post (14A, 14B).

7. Improved system according to any on of claims 1 to 6, characterised in that transverse anti-toppling beams (15A, 15B) are attached to the top of each support post (2A, 2B, etc.) and embrace laterally the ends of two aligned beams (1A, 1B) on the same post (2B), these transverse beams being adapted to support technical equipment such as air conditioning, heating or other equipment.

8. Improved system according to any one of claims 1 to 7, characterised in that the longitudinal axis of each buttress leg member ($4_1$, $4_2$, etc.) is at an angle to the longitudinal axis of symmetry (X—X) of the corresponding post (2A, 2B, 2C, etc.) between 30° and 60° and preferably substantially 45.

9. Improved system according to claim 2, characterised in that each of the end posts (2A) comprises a single buttress leg member ($3A_1$) adapted to receive the end of the end long-span beam (1A) of the structure, the second buttress leg member being replaced by a bracing leg member ($3A_2$) balancing the buttress force $R_P$ applied to the post by the buttress leg member ($3A_1$).

10. Improved system according to any one of claims 1 to 3, characterised in that the contact members ($8_1$, $8_2$, etc.) with which the corner strengthening member ($7_1$, $7_2$) of the long-span beam (1A, 1B, etc.) is provided comprise two small-diameter cylindrical members ($8_1$—$8_1$, $8_2$—$8_2$) orthogonal to the beam and adapted to bear on respective wings of the two-wing channel ($6_1$, $6_2$) attached to the upper end of the buttress leg member ($4_1$, $4_2$, etc.), these contacts constituting points through which the forces are obliged to pass.

11. Improved system according to claim 2, characterised in that, in one embodiment, the corner strengthening member ($7_1$, $7_2$) of the beam (1A, 1B) is provided with a single larger diameter contact cylinder ($8_1$ or $8_2$) orthogonal to the beam which bears on both wings of the two-wing channel ($6_1$, $6_2$) attached to the upper end of the buttress leg member ($4_1$, $4_2$, etc.) along two separate generatrices of said cylinder, these contacts constituting points through which the forces are obliged to pass.

12. Improved system according to claim 2, characterised in that each buttress leg member ($4_1$, $4_2$, etc.) is made by welding longitudinally (9) two asymmetrical U-shaped cross-section members (10A, 10B) and in that, facing the articulations ($5_1$, $5_2$) between leg member and post, anti- buckling reinforcing plates are fixed to the lateral surfaces of the leg member (13A, 13B) and to the lateral surfaces of the flanges of the post (14A, 14B).

13. Improved system according to 2, characterised in that transverse anti-toppling beams (15A, 15B) are attached to the top of each support post (2A, 2B, etc.) and embrace laterally the ends of two aligned beams (1A, 1B) on the same post (2B), these transverse beams being adapted to support technical equipment such as air conditioning, heating or other equipment.

14. Improved system according to 2, characterised in that the longitudinal axis of each buttress leg member ($4_1$, $4_2$, etc.) is at an angle to the longitudinal axis of symmetry (X—X) of the corresponding post (2A, 2B, 2C, etc.) between 30° and 60° and preferably substantially 45°.

15. Improved system according to 3, characterised in that the contact members ($8_1$, $8_2$, etc.) with which the corner strengthening member ($7_1$ $7_2$) of the long-span beam (1A, 1B, etc.) is provided comprise two small-diameter cylindrical members ($8_1$—$8_1$, $8_2$–$8_2$) orthogonal to the beam and adapted to bear on respective wings of the two-wing channel ($6_1$, $6_2$) attached to the upper end of the buttress leg member ($4_1$, $4_2$, etc.), these contacts constituting points through which the forces are obliged to pass.

16. Improved system according to claim 3, characterised in that, in one embodiment, the corner strengthening member ($7_1$, $7_2$) of the beam (1A, 1B) is provided with a single larger diameter contact cylinder ($8_1$ $8_2$) orthogonal to the beam which bears on both wings of the two-wing channel ($6_1$–$6_2$) attached to the upper end of the buttress leg member ($4_1$–$4_2$, etc.) along two separate generatrices of said cylinder, these contacts constituting points through which the forces are obliged to pass.

17. Improved system according to claim 3, characterised in that each buttress leg member ($4_1$–$4_2$, etc.) is made by welding longitudinally (9) two asymmetrical U-shaped cross-section members (10A, 10B) and in that, facing the articulations ($5_1$, $5_2$) between leg member and post, anti- buckling reinforcing plates are fixed to the lateral surfaces of the leg member (13A, 13B) and to the lateral surfaces of the flanges of the post (14A, 14B).

18. Improved system according to claim 3, characterised in that transverse anti-toppling beams (15A, 15B) are attached to the top of each support post (2A, 2B, etc.) and embrace laterally the ends of two aligned beams (1A, 1B) on the same post (2B), these transverse beams being adapted to support technical equipment such as air conditioning, heating or other equipment.

19. Improved system according to 3, characterised in that the longitudinal axis of each buttress leg member ($4_1$, $4_2$, etc.) is at an angle to the longitudinal axis of symmetry (X—X) of the corresponding post (2A, 2B, 2C, etc.) between 30° and 60° and preferably substantially 45°.

* * * * *